US008281979B1

(12) United States Patent
Pfanstiehl

(10) Patent No.: US 8,281,979 B1
(45) Date of Patent: Oct. 9, 2012

(54) CAN DISPENSER FOR A CARTON

(76) Inventor: John Pfanstiehl, Indian Rocks Beach, FL (US)

( * ) Notice: Subject to any disclaimer, the term of this patent is extended or adjusted under 35 U.S.C. 154(b) by 398 days.

(21) Appl. No.: 12/635,797

(22) Filed: Dec. 11, 2009

(51) Int. Cl.
*B65D 5/72* (2006.01)
*B65D 17/28* (2006.01)

(52) U.S. Cl. ..... 229/122.1; 221/305; 229/242

(58) Field of Classification Search ..... 229/121, 229/122, 122.1, 240, 242; 221/302, 303, 221/305; 206/427
See application file for complete search history.

(56) References Cited

U.S. PATENT DOCUMENTS

| | | | | | |
|---|---|---|---|---|---|
| 2,299,027 | A | * | 10/1942 | Novak | 229/122.1 |
| 3,750,930 | A | * | 8/1973 | Roth | 229/122 |
| 3,894,681 | A | | 7/1975 | Arneson et al. | |
| 4,216,861 | A | | 8/1980 | Oliff | |
| 4,364,509 | A | | 12/1982 | Holley et al. | |
| 4,396,143 | A | | 8/1983 | Killy | |
| 4,577,799 | A | | 3/1986 | Oliff | |
| 4,817,866 | A | | 4/1989 | Wonnacott | |
| 5,228,590 | A | | 7/1993 | Blasko et al. | |
| 5,368,194 | A | | 11/1994 | Oliff et al. | |
| 5,375,702 | A | * | 12/1994 | Fiallo | 206/45.21 |
| 5,505,372 | A | | 4/1996 | Edson et al. | |
| 5,878,947 | A | | 3/1999 | Hoy et al. | |
| 6,176,419 | B1 | | 1/2001 | Holley | |
| 6,578,736 | B2 | | 6/2003 | Spivey | |
| 6,604,674 | B1 | * | 8/2003 | Bowman | 229/116.5 |
| 6,669,083 | B2 | | 12/2003 | Bates | |
| 7,000,803 | B2 | * | 2/2006 | Miller | 221/302 |
| 7,467,713 | B2 | | 12/2008 | Harrelson | |
| 7,475,777 | B2 | | 1/2009 | Fung et al. | |
| 2003/0150759 | A1 | | 8/2003 | White | |
| 2004/0089671 | A1 | | 5/2004 | Miller | |
| 2004/0099558 | A1 | * | 5/2004 | Oliff et al. | 206/427 |
| 2007/0210144 | A1 | * | 9/2007 | Brand | 229/122.1 |
| 2007/0278120 | A1 | * | 12/2007 | Ho Fung et al. | 206/427 |
| 2009/0057384 | A1 | * | 3/2009 | Learn | 229/117.16 |

* cited by examiner

*Primary Examiner* — Gary Elkins

(57) ABSTRACT

A dispensing carton and method for dispensing beverage cans is disclosed. The carton enables end-users to easily remove cans from the carton without the common problem of additional cans inadvertently falling out. After removing tear outs, the dispenser flap is folded upon itself and then onto the lower panel to keep cans from rolling out. Optional locking tabs can be used to keep the flap folded. Optional thumb grips and added slits can make tear out removal easier and less trouble prone. The new carton uses existing size carton blanks and requires no added components and no added cost for materials or labor. Furthermore, no changes to manufacturing equipment or manufacturing processes in making carton blanks, assembling the cartons, filling the cartons or transporting the filled cartons are needed.

18 Claims, 8 Drawing Sheets

CAN DISPENSER FOR A CARTON

FIELD OF THE INVENTION

The present invention relates to cartons that package multiple cans of beverages and that incorporate tear out panels to permit dispensing of one can at a time.

BACKGROUND OF THE INVENTION

Cartons that package multiple cans of beverages, such as 12-pack beer cartons, and that incorporate tear out panels to permit dispensing of one can at a time are well known. The common problem of gravity causing multiple cans to fall through the dispensing opening is also well known. Prior art shows a number of attempts to solve this problem. The field is crowded due to the sizeable impact an improved carton can have on the multibillion dollar canned beverage market. For example, the introduction of the 6×2 12-pack initially labeled the FridgePack was reported by the Wall Street Journal to have increased sales of Coca-Cola's canned sodas by 10% and now the majority of soda 12-packs are 6×2.

U.S. Pat. No. 3,894,681 to Arneson et al. (Jul. 15, 1975) and assigned to the Federal Paper Board Company, Inc, describes a carton with tear out panel for dispensing. FIG. 4 of the '681 patent shows how flap 92 extends over the cylindrical surface of can C to help prevent the force of other cans from pushing can C out of the carton. This method is still in common use for 4×3 12-packs of beer such as Coors. The problem is that the flap is bent with removal of each can and becomes weakened, and the flap is further weakened by creases or by becoming wet or humid.

U.S. Pat. No. 4,364,509 to Holley et al (Dec. 21, 1982) and assigned to Mead Corporation also describes a carton with tear out panel for dispensing. FIG. 4 of the '509 patent shows flap 25 tucked in to close the opening to prevent dispensing, and FIG. 5 thereof shows the flap pulled out for dispensing. This method is not in common use. The problem is that multiple cans can fall through the dispenser when the flap is not tucked in and therefore, the flap needs to be opened and then tucked in again after removal of each can.

U.S. Pat. No. 4,396,143 to Killy (Aug. 2, 1983) and assigned to Manville Service Corporation also describes a carton with tear out panel for dispensing. FIG. 1 of the '143 patent shows dispenser 50 prior to opening. FIG. 2 thereof shows the tear out panel pulled out for dispensing. Flaps 58, 60 extend down over the cylindrical surface of the visible can to help prevent the force of other cans from the pushing that can out of the carton. The problem, as with the aforementioned U.S. Pat. No. 3,894,681, is that the flaps are bent with removal of each can and become weakened, and the flaps are further weakened by creases or by becoming wet or humid. Tabs 62, 64 extend up to add further resistance to the can but they have minimal strength to do so as they are simply small tabs of thin paperboard material that are hinged at the crease of the lower corner. This method is not in common use.

U.S. Pat. No. 4,817,866 to Wonnacott (Apr. 4, 1989) and assigned to St. Regis Packaging Limited also describes a carton with an embodiment with tear out panel for dispensing. FIG. 4 of the '866 patent shows the tear out panel pulled out for dispensing. Reinforced handle strap 20 extends down partially over the cylindrical surface of can 31 to help prevent the force of other cans from the pushing it out of the carton. This is not suitable for 4×3 12-packs because the reinforced handle strap would be centered and therefore, not in position to contact the end can on either the 4-can or the 3-can end panels. A further problem is that the reinforced handle strap is an added component that adds to packaging costs and packaging procedures. This method of preventing unwanted can dispensing is not in common use.

U.S. Pat. No. 5,228,590 to Blasko et al. (Jul. 20, 1993) also describes a carton with tear out panel for dispensing. FIG. 1 of the '590 patent shows dispenser tear out panel 5 prior to opening. FIG. 2 thereof shows a separate component, a rigid article stopper 11. FIG. 3 thereof shows the tear out panel pulled out for dispensing with article stopper 11 inserted in the dispenser. The problem is that the rigid article stopper is an added component that adds to packaging costs and packaging procedures. This method is not in common use.

U.S. Pat. No. 5,368,194 to Oliff et al. (Nov. 29, 1994) and assigned to Mead describes a carton with tear out panel for dispensing. FIG. 7 of the '194 patent shows the dispenser tear out panels prior to opening. FIG. 8 thereof shows the tear out panels pulled out for dispensing cans C1, C2, Cans are prevented from falling out due to the dispenser vertical opening being less than the OD of the can and the horizontal opening being shorter than the longitudinal length of the can. The problem is that smaller dispenser opening makes it impossible to grip both ends of the can. Furthermore, the reduced size of the opening requires twisting and prying to remove the can. Both these problems make it more difficult for the consumer to remove cans. This method is not in common use.

U.S. Pat. No. 5,878,947 to Hoy et al. (Mar. 9, 1999) describes a carton with tear out panel for dispensing. FIG. 1 of the '947 patent shows dispenser tear out panel 50 prior to opening. FIG. 2 thereof shows the tear out panel pulled out for dispensing. After the flap is separated on its top and sides and then folded down, strips 58, 60 are connected together to form a triangle that is intended to prevent cans 52 from rolling out of the carton. One problem is that the procedure is somewhat complex and would be difficult for some consumers. The second problem is that the extended flap and the triangle need to be supported by a rigid shelf, or they will bend down and be rendered ineffective. This requires much greater shelf space, which is typically a premium in refrigerators. This method is not in common use.

U.S. Pat. No. 6,176,419 to Holley (Jan. 23, 2001) and assigned to Mead describes a carton with tear out panel for dispensing. FIG. 3 of the '419 patent shows the dispenser open. Flaps 95, 97 extend down over the cylindrical surface of the visible can to help prevent the force of other cans from pushing it out of the carton. The problem, as with the aforementioned U.S. Pat. Nos. 3,894,681, and 4,396,143, is that the flaps are bent with removal of each can and become weakened, and the flaps are further weakened by creases or by becoming wet or humid. Flap 40 tries to solve this problem by being tucked under flaps 95, 97 to close the opening as shown in FIG. 4. However, this requires that the flap needs to be opened and then tucked back in after removal of each can. This method is not in common use.

U.S. Pat. No. 6,669,083 to Bates (Dec. 30, 2003) and assigned to Meadwestvaco Packaging Systems, LLC describes a carton with tear out panel for dispensing. FIG. 3 of the '083 patent shows the dispenser open. One end of flap 140 is trapped behind panel 144 and therefore resists cans falling out. In addition, cans are prevented from falling out due to the dispenser vertical opening being less than the diameter of the can and the horizontal opening being shorter than the longitudinal length of the can. The problem as with aforementioned U.S. Pat. No. 5,368,194, is that smaller dispenser opening makes it impossible to grip both ends of the can. Furthermore, the reduced size of the opening requires twisting and prying to remove the can. The unexposed end of the can needs to be forced back against the pressure of the other cans to twist the can forward and out. Both these problems make it more difficult for the consumer to remove cans. This method is not in common use.

U.S. Pat. No. 6,578,736 to Spivey (Jun. 17, 2003) and assigned to Riverwood International Corporation, describes a carton with tear out panel for dispensing. FIG. 2 of the '736 patent shows the dispenser being opened. FIG. 3 thereof shows the dispenser open with the tear out section becoming a cradle for one can. The dispenser opening extends from the end panel onto the top panel and both side panels. This does not work for 4×3 12-pack cartons that dispense cans from the bottom (to enable a free flow of cans to the dispenser opening). Furthermore, the cradle takes up more shelf space in already crowded refrigerators.

U.S. Pat. No. 7,475,777 Fung et al. (Jan. 13, 2009) and assigned to Graphic Packaging International shows in FIG. 10 another variant of a carton that employs a can stop that extends outside the normal footprint of the carton. A problem is that the extended stop needs to be supported by a rigid shelf or it will bend down and be rendered ineffective. This requires greater shelf space, which is typically a premium in refrigerators. An additional problem is that the extended stop is the only means to prevent unwanted ejection of cans. Furthermore, the extended stop enables one can to sit partially out of the carton and this creates pressure on the can from the cans on top of it and behind it. This pressure puts greater force on the extended stop, increases its likelihood of failing, and causes a forceful ejection of cans from the carton when the extended flap fails.

U.S. Pat. Appl. Pub. No. 20040089671 to Miller (May 13, 2004) and assigned to C.W. Zumbiel Company describes a carton with tear out panel for dispensing. FIG. 4 of the '671 patent application shows the dispenser being opened. FIG. 5 thereof shows the dispenser flap tucked back into top panel 16 of the carton. The purpose for tucking the flap up onto the top panel is to enable the opening to be closed for future transport and to preserve advertising or promotional messages on the outside of the carton. The dispenser opening is on the top panel and the end panel. This does not work for 4×3 12-pack cartons that dispense cans from the bottom (to enable a free flow of cans to the dispenser opening).

The following patents and patent applications represent prior art cartons with tear out panels for dispensing that are either similar to the aforementioned patents or that are further removed from the present invention.

U.S. Pat. No. 4,216,861 to Oliff (Aug. 12, 1980) is assigned to Mead. FIG. 6 thereof shows large tear out 54 on the side panel.

U.S. Pat. No. 4,577,799 to Oliff (Mar. 25, 1986) is also assigned to Mead. FIG. 2 thereof shows a large tear out on the side panel. FIG. 1 thereof also shows end panel 11 that has tabs 47 and 48 to lock together with end panel 7 instead of using glue.

U.S. Pat. No. 5,505,372 to Edson et al. (Apr. 9, 1996) and assigned to Graphic Packaging Corporation, shows in FIG. 2 a 24-pack carton with three large tear outs on multiple panels.

U.S. Pat. No. 7,467,713 to Harrelson (Dec. 23, 2008) and assigned to Graphic Packaging International, shows in FIG. 6 and FIG. 7 another variant of a 24-pack carton with a large tear out on both a side panel and an end panel.

U.S. Pat. Appl. Pub. No. 20030150759 to White (Aug. 14, 2003) is the last cited prior art and shows in FIG. 4 a variant of a 12-pack carton with large tear out on what is commonly used as the top panel.

None of the prior art shows a carton that packages multiple cans of beverages, such as a 4×3 12-pack carton, that incorporates a tear out panel that is effective at permitting the easy dispensing of one can at a time and at the same time prevents multiple cans from falling through the dispensing opening and that accomplishes this without incurring higher production costs or increasing the shelf space needed when the carton is opened.

SUMMARY OF THE INVENTION

The object of the present invention is to eliminate a common problem of cartons that package multiple cans of beverages which incorporate tear out panels to permit dispensing of one can at a time, specifically preventing multiple cans from inadvertently falling through the dispenser opening.

Another object of the present invention is to eliminate the common problem without adding another component to the packaging.

Another object of the present invention is to eliminate the common problem without increasing the shelf space needed when the carton is opened.

Another object of the present invention is to eliminate the common problem without adding to the size of the blank needed to construct the carton.

Another object of the present invention is to eliminate the common problem without adding to the material cost of the carton.

Another object of the present invention is to eliminate the common problem without adding to the production cost of the carton.

Another object of the present invention is to eliminate the common problem without requiring any change to the carton manufacturing equipment.

Another object of the present invention is to eliminate the common problem without requiring any change to the beverage packaging equipment.

Another object of the present invention is to eliminate the common problem without requiring any change to the size of the carton.

Another object of the present invention is to eliminate the common problem without requiring any change to distribution equipment.

Another object of the present invention is to eliminate the common problem without requiring any change to the retail shelf space or storage.

Another object of the present invention is to enable the can to be grasped by both its top and bottom surfaces to facilitate removal of the can from the carton.

Another object of the present invention is to eliminate the common problem without requiring any change to the carton manufacturing equipment.

Another object of the present invention is to eliminate the common problem and enable the carton to be substantially re-closed to facilitate transportation after opening.

Another object of the present invention is to eliminate the common problem without requiring any complicated procedures by the consumer.

The present invention provides a beverage carton that militates against multiple cans from inadvertently falling through the dispensing opening while minimizing the number of components and minimizing a cost of the carton. Furthermore, it does this without requiring changes to the separate pieces of industrial equipment needed for producing the carton blanks, assembling the cartons, filling the cartons or transporting the filled cartons. In addition, the procedure for opening the dispenser is easily understood and easily performed by the consumer.

BRIEF DESCRIPTION OF THE DRAWING

The above, as well as other advantages of the present invention, will become readily apparent to those skilled in the art from the following detailed description of a preferred embodiment when considered in the light of the accompanying drawings—in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1A:
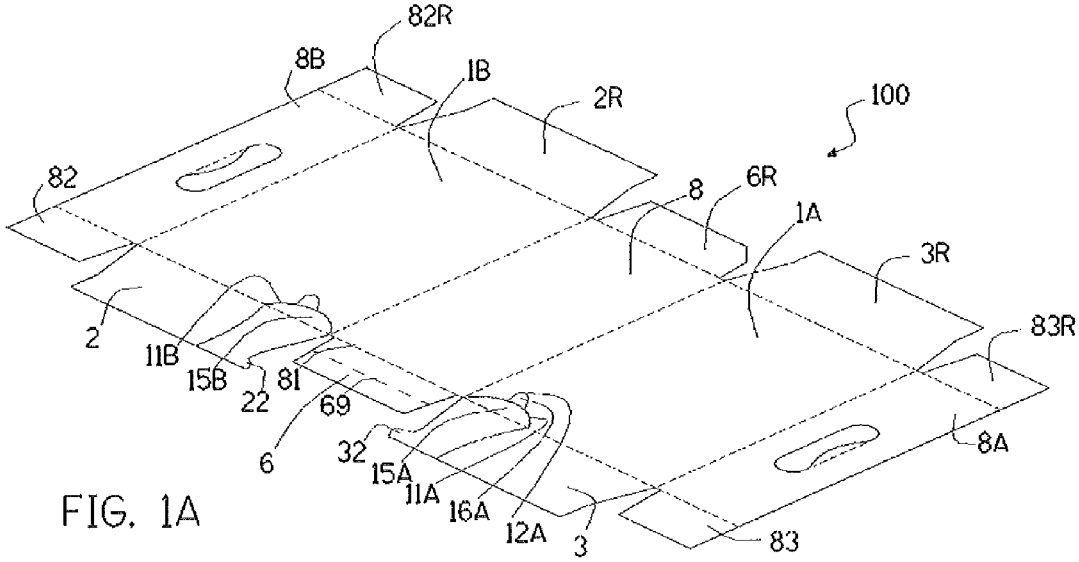
FIG. 1A is a perspective view of the present invention as a blank for a 12-pack carton prior to being folded and glued into a carton. The reference numbers in FIG. 1A correspond to the same components in FIG. 1B.
Figure 1B:
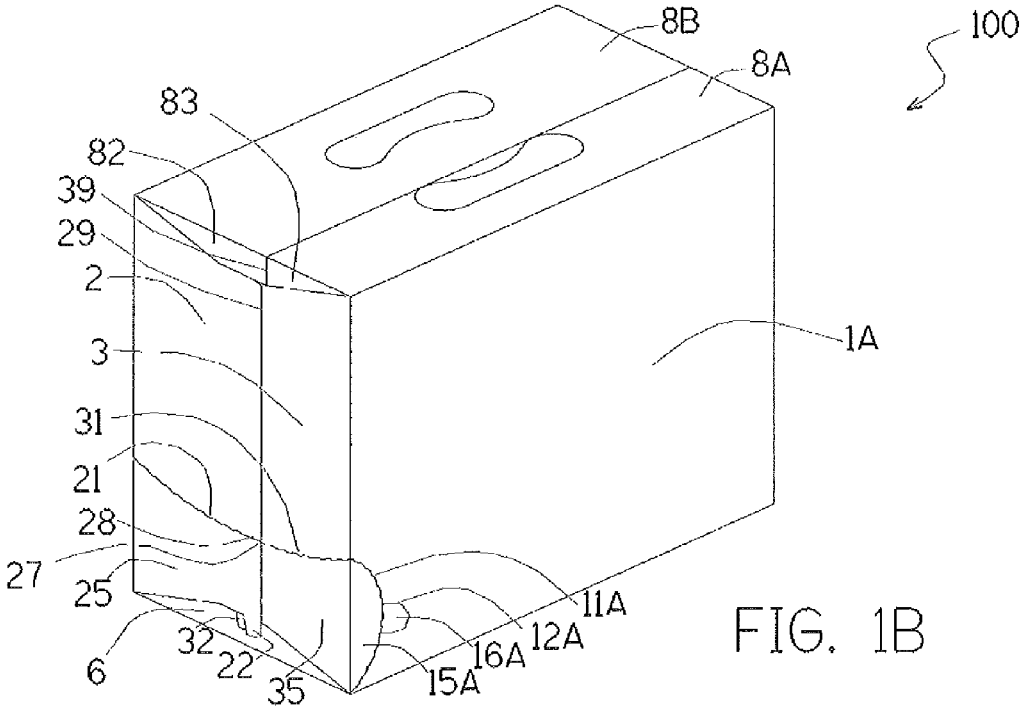
FIG. 1B is a perspective view of the present invention in a 12-pack carton after being folded and glued into a carton but prior to the dispenser being opened.

FIG. 1A illustrates components of the present invention as a blank for a 12-pack one-piece carton 100. FIG. 1B illustrates components of the present invention as the 12-pack carton 100 assembled into a hollow carton and filled with storage cans of a beverage or the like (not shown). A right side panel 1A is hingedly attached to a lower panel 8 (not shown in FIG. 1B), as is a left side panel 1B (not shown in FIG. 1B). The upper structure is made from an upper right flap 8A and an upper left flap 8B.

The rear end closure structure is formed from five overlapping flaps: a rear upper right flap 83R hingedly attached to the upper right flap 8A, a rear upper left flap 82R hingedly attached to the upper left flap 8B, a rear right flap 3R hingedly attached to the right side panel 1A, a rear left flap 2R hingedly attached to the left side panel 1B, and a rear lower flap 6R hingedly attached to the lower panel 8. Each of the five flaps forming the rear end closure structure is affixed to at least one of the other flaps in the rear end closure structure.

The front end closure structure is formed from five overlapping flaps: a front upper right flap 83 hingedly attached to the upper right flap 8A, a front upper left flap 82 hingedly attached to the upper left flap 8B, a front right flap 3 hingedly attached to the right side panel 1A, a front left flap 2 hingedly attached to the left side panel 1B (not shown in FIG. 1B). and a front lower flap 6 hingedly attached to the lower panel 8.

A can dispenser opening is formed from removing a right side tear out section 15*a* on the right side panel 1A, a left side tear out section 15*b* on the left side panel 1B (not shown in FIG. 1B), a tear out 35 on the front right flap 3, and a tear out 25 on the front left flap 2. When the tear outs 15*a*, 15*b*, 35, 25 are removed, a single beverage can is grasped by its ends and is removed from the bottom of the carton 100.

The right side panel 1A has a linear array of serrations 11A to enable the right side tear out section 15*a* to be easily separated from the right side panel 1A. Similarly, the front right flap 3 has a linear array of serrations 31 to enable the tear out section 35 to be easily separated from the front right flap 3, and the front left flap 2 has a linear array of serrations 21 to enable the tear out section 25 to be easily separated from the front left flap 2. The left side panel 1B has a linear array of serrations 118 (not shown in FIG. 1B) to enable the left side tear out section's 5*b* (not shown in FIG. 1B) to be separated from left side panel 1B similar to removal of tear out section 15A from the right side panel 1A.

Removal of the tear out 25 on front left flap 2 is made easier by a tab that extends downwardly from the lower corner of front left flap 2 to form a thumb tab 22 which is not glued to the underlying tear out section 35 or to the front lower flap 6. After removal of the tear out 25, removal of the tear out 35 is made easier by a thumb tab 32 on the lower corner of front right flap 3, Thumb grip 32 is not glued to the underlying front lower flap 6.

Alternately, a finger tab 16A is separated from the right side panel 1A by a cut-through 12A that is pushed inwardly to allow gripping of the right side tear out section 15A and thereby facilitates removal of the tear outs 15A, 35, 25, 15B (15B not shown in FIG. 1B). The finger tab 16A works optimally when it is over the bottom of the beverage can because the bottom surface of the beverage can is typically concave and that permits finger tab 16A to be pushed further into the carton making tear out 15A more easily grasped. A similar finger tab can be employed on the left side tear out section.

Removal of the tear out 25 is further made easier by a slit 28 that is longer than the other cuts in the serrations 21 and which extends from an edge 29 of front left panel 2 at corner 27. The extended slit 28 helps insure that the carton 100 is torn in the proper location on the serrations 21, and not torn in an unwanted area.

Figure 2A:
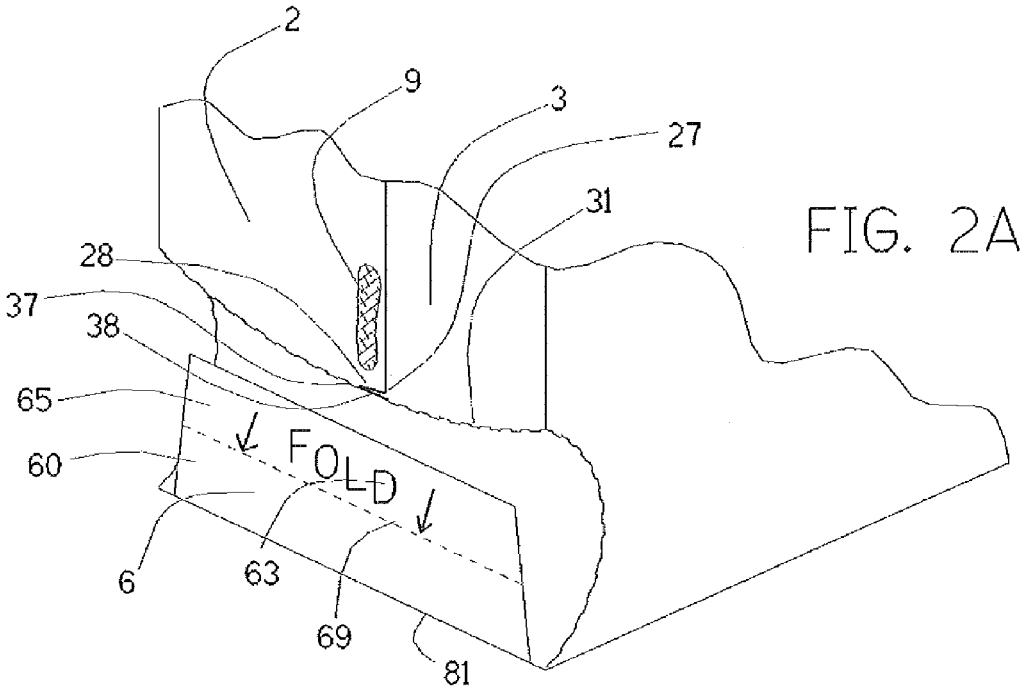
FIG. 2A is a fragmentary perspective view of the present invention with the dispenser partially opened.

FIG. 2A illustrates the present invention with the tear outs 25, 35 removed, and exposes slit 38 and a corner 37. Removal of the tear out 35 is made easier by the slit 38 which is longer than the other cuts in the serrations 31, and can extend to the outward edge 39 (shown in FIG. 1B) of front right flap 3 at corner 37.

An adhesive or glue 9 applied under the flap 2 near the corner 27 adheres to the flap 3 and strengthens a bond therebetween at this location. This also helps insure that the carton 100 is torn in the proper location, on the serrations 31 and is not torn in an unwanted area.

The application of the glue 9 is minimized or eliminated on the overlapping surfaces of the tear out 25 (not shown in FIG. 2A) and the front lower flap 6, and on the overlapping surfaces of the tear out 35 and the front lower flap 6. This facilitates removal of the tear outs 25, 35 (not shown in FIG. 2A) and minimizes the chance of tears in the front lower flap 6.

Removal of the tear outs 25, 35 enables the can to be grasped by both its top and bottom surfaces to facilitate removal of the can from the carton.

A height of the tear out 15A is substantially the same as a diameter of the beverage can to enable easy extraction of the cans from the carton 100. The lower corner 27 of the front left flap 2 and the lower corner 37 of the front right flap 3 extend farther down than the cut out 15A, and thereby provide additional resistance to cans inadvertently falling out.

FIG. 2A illustrates the dispenser of the present invention after removal of the previously described tear outs 15A, 35, 25, 15B. A seam 81 is a line formed by the hinged attachment of the front lower flap 6 to the lower panel 8. In conventional cartons, the seam 81 is typically partially serrated so that the front lower flap 6 can be removed along with the tear outs 15A, 35, 25, 15B. In the present invention, the seam 81 does not have to be serrated, and the front lower flap 6 is not removed.

Instructions or other indicia 63 can be printed on the front lower flap 6, or anywhere on the exterior of the carton 100. The instructions 63 can be text, diagrams or both.

Figure 2B:
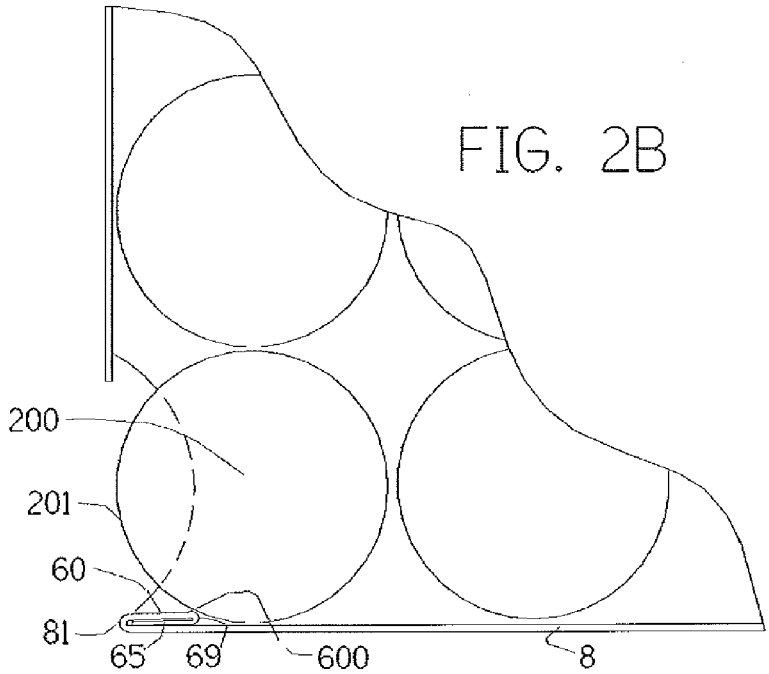
FIG. 2B is a fragmentary sectional side elevational view of the present invention with the dispenser flap folded upon itself and cans completely within the carton.

On the front lower flap 6, a lower half 60 abuts an upper half 65 along a fold line 69. Fold line 69 is made of a line of serrations or is a linear indentation to facilitate bending. FIG. 2B illustrates the upper half 65 folded inward and down onto the inner surface of the lower half 60 to form a folded flap 600, and then the folded flap 600 is folded down onto the lower panel 8. Fold line 69 is located at a substantially midpoint between an upper edge 61 of front lower flap 6 and the line formed by the hinged attachment of the front lower flap 6 to the lower panel.

The fold line 69 abuts a cylindrical outer surface 201 of a can 200 and prevents the can 200 from inadvertently rolling out of the carton 100 in the same manner as a wheel chock prevents a wheel from rolling. It is in effect a wheel chock with a height of at least twice a thickness of a paperboard from which the carton 100 is produced. In practice, the effective height of the double folded flap is substantially greater than twice the thickness of the paperboard. A double-folded flap of 0.020 inch paperboard can create an effective height exceeding 0.125 inches.

Figure 2C:
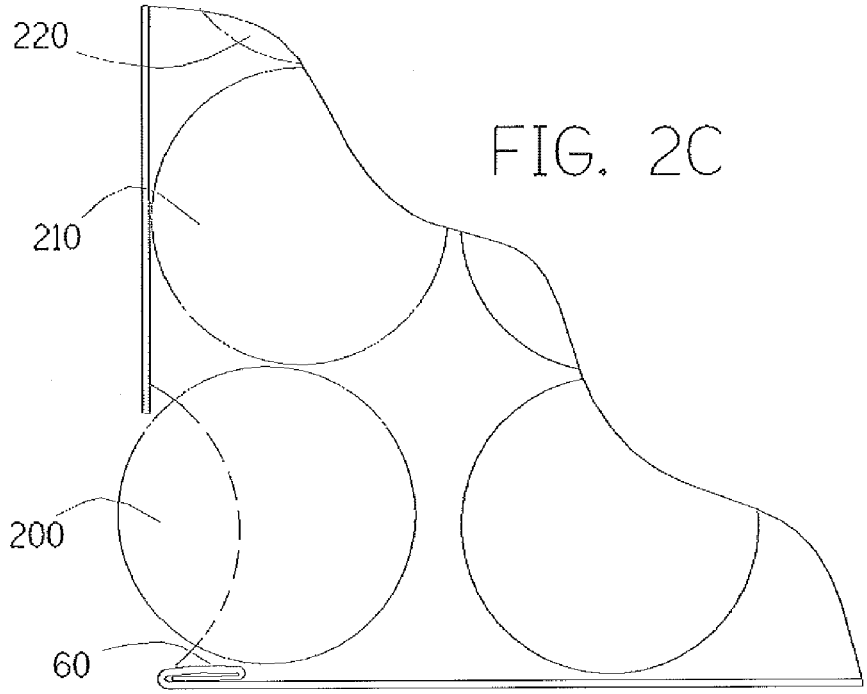
FIG. 2C is a fragmentary sectional side elevational view of the present invention with the dispenser flap folded upon itself and one can raised up on the folded flap as the can is moving out of the carton.

Removal of the can 200 from the carton 100 also requires that the can 200 move up over the two layer folded flap, as illustrated in FIG. 2C. This upward movement requires forcing a can 210 and a can 220 upward, both of which are located above the can 200. By this required action, the present invention thereby creates a second means to prevent inadvertent ejection of cans.

Figure 2D:
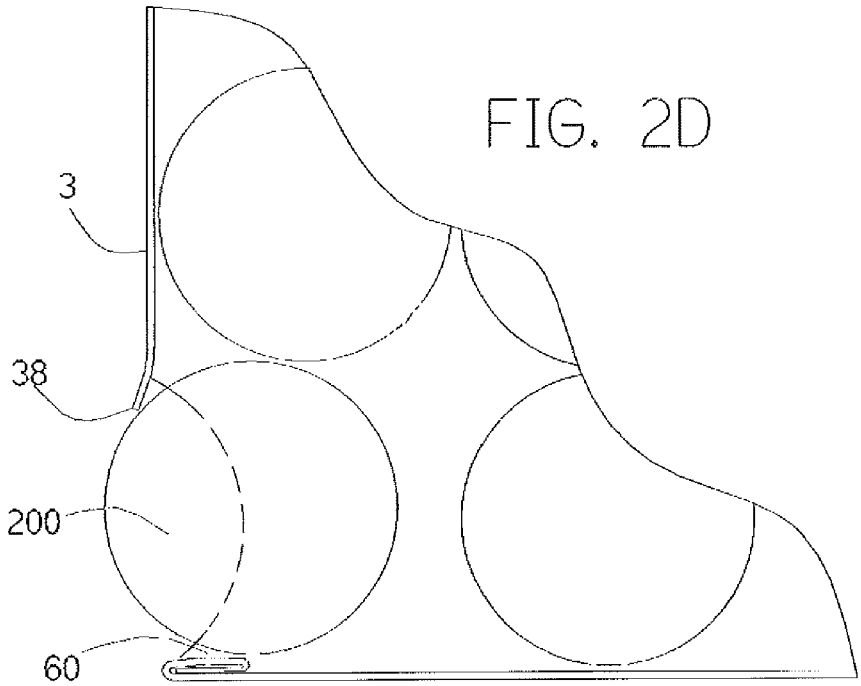
FIG. 2D is a fragmentary sectional side elevational view of the present invention with the dispenser flap folded upon itself and one can raised upon the folded flap as it is moving farther out of the carton and pressing against the carton at the upper side of the dispenser opening.

As the can 200 is pulled out through the dispenser opening, as illustrated in FIG. 2D, the additional height of the can 200 as it rolls over the double-folded flap 6 requires greater deflection of the dispenser opening at its lowest edge identified by the extended slit 38. The present invention thereby creates a third means to prevent cans from inadvertently falling out.

Figure 2E:
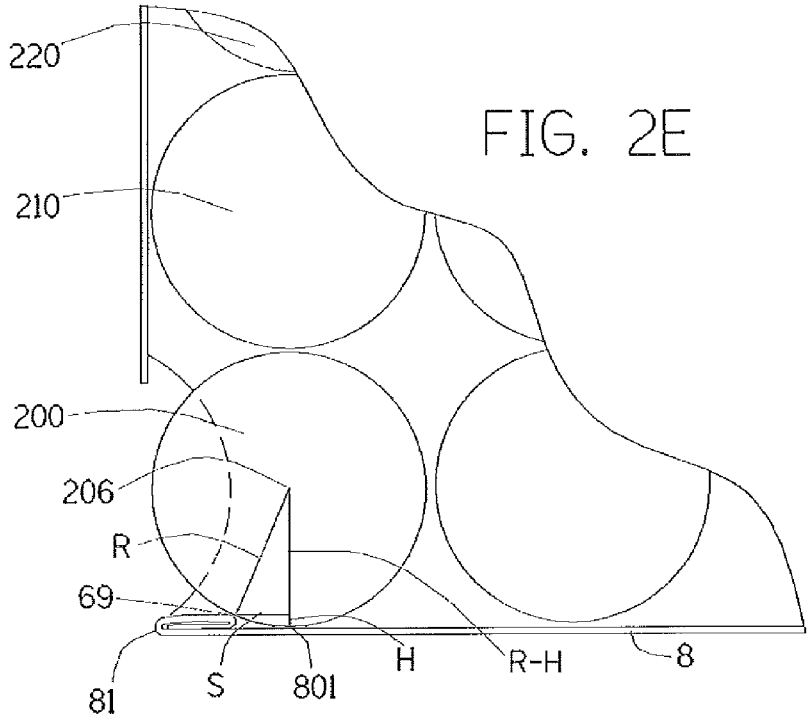
FIG. 2E is a fragmentary sectional side elevational view of the present invention with the dispenser flap folded upon itself and cans completely within the carton to illustrate the geometry of the dispenser flap dimensions.

FIG. 2E illustrates the geometry of the preferred dispenser flap dimensions. The dimension from a center 206 of the can 200 to the flap fold line 69 is a radius of the can 200, as is the dimension from a center 206 of the can 200 to the bottom surface of lower panel 8 at a point of contact 801. A distance from the seam 81 to the fold line 69 when added to triangle opposite side S also equals the radius of the can 200. As noted hereinabove, the effective height of the double-folded flap 6 is approximately 0.125 inches for a paperboard that is 0.020 inches thick. When the radius of a can is 1.25 inches, the dimension for the triangle opposite side S is computed by the Pythagorean theorem to be approximately 0.55 inches. Subtracting this value from radius value 1.25 inches provides an approximate dimension of 0.70 inches for the length from the seam 81 to the fold line 69. The amount subtracted from the radius can also be expressed as the square root of the following: the diameter of the can times the effective height of the folded flap minus the square of the effective height of the folded flap. In practice, the paperboard material and the clearance of cans inside a carton can provide reason to increase or decrease this dimension.

In the embodiment shown, the double-folded flap 6 is sufficiently long so that it holds the can 200 at a position completely within the carton 100. When the can 200 is fully within the carton 100, the can 210 and the can 220 are stacked in vertical alignment above the can 200 and the mass of the cans 210, 220 is nearly balanced.

Therefore, there is little or no force upon the can 200 biasing it toward the dispenser opening. This is a fourth means by which the present invention prevents inadvertent ejection of cans.

Figure 2F:
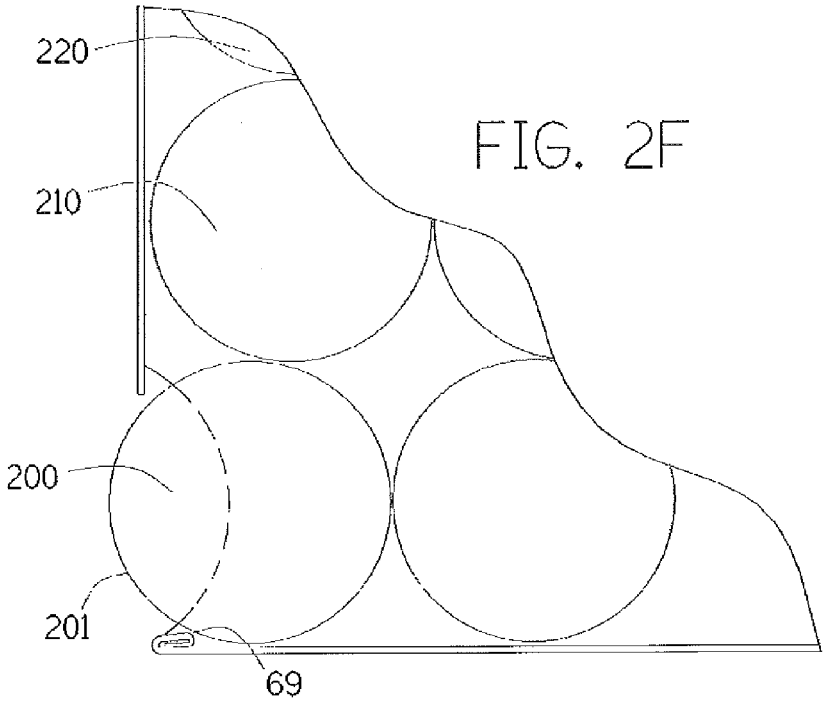
FIG. 2F is a fragmentary sectional side elevational view of another embodiment of the present invention with a shorter dispenser flap folded upon itself and one can abutting the dispenser flap.

By comparison, FIG. 2F illustrates a double folded flap 6 that is shorter than the embodiment described hereinabove. Because the double folded flap 6 is shorter, the can 200 rolls partially out of the carton 100 until it contacts the fold line 69. In this position, the can 210 and the can 220 are stacked above and behind the can 200. The weight of the cans 210, 220 is off the vertical centerline of the can 200 and the cans 210, 220 are therefore, no longer balanced on the can 200. This results in some forces upon the can 200 biasing it toward the dispenser opening.

Figure 3A:
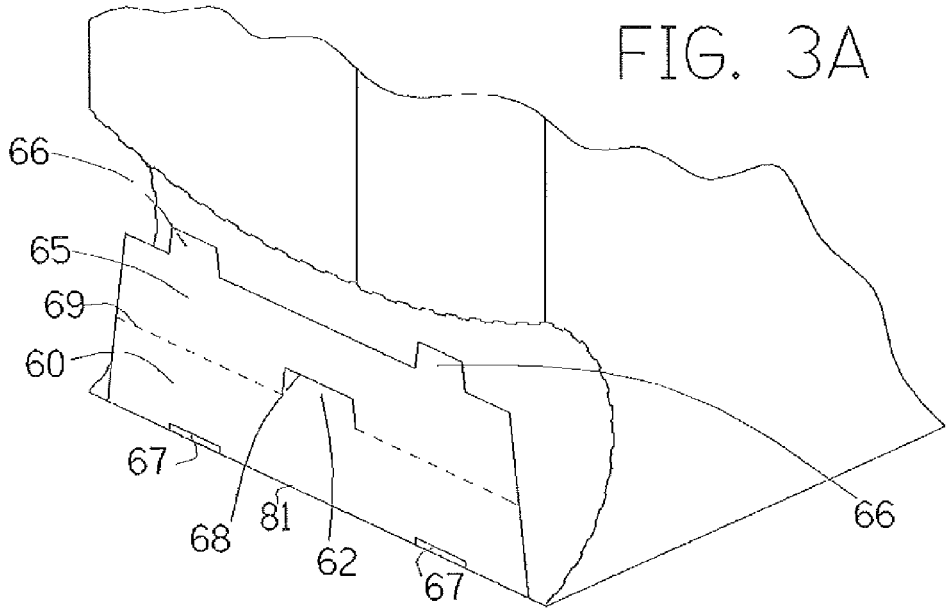
FIG. 3A is a fragmentary perspective view of another embodiment of the present invention with locking tabs with the dispenser partially opened.
Figure 3B:
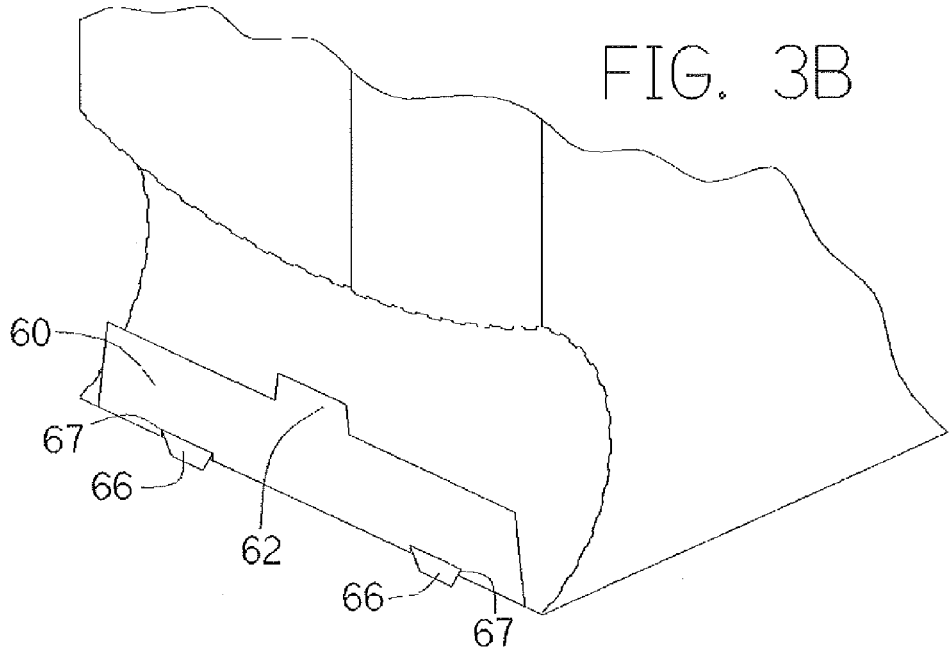
FIG. 3B is a fragmentary perspective view of the embodiment of the present invention shown in FIG. 3A with the dispenser partially opened and the dispenser flap folded upon itself and secured by locking tabs.
Figure 3C:
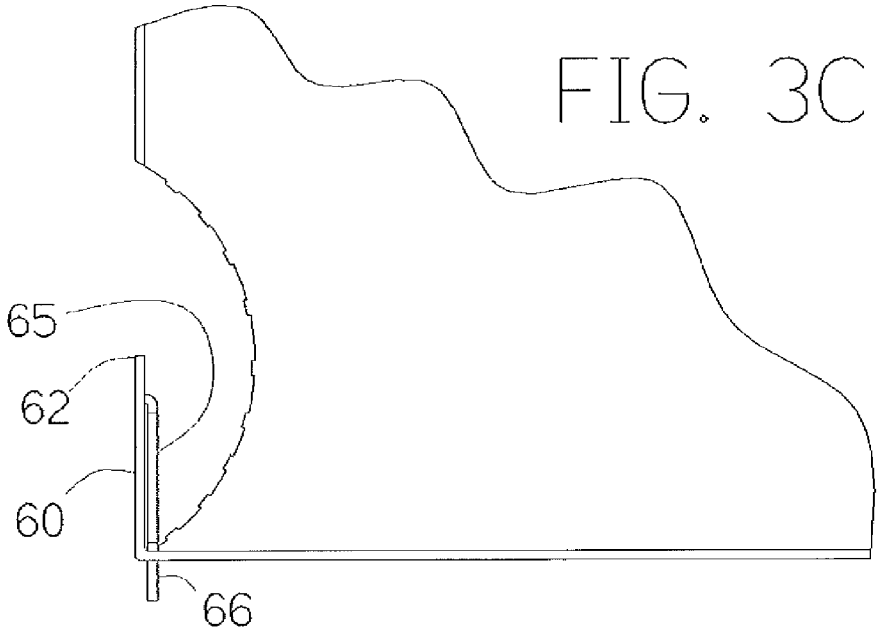
FIG. 3C is a fragmentary sectional side elevational view of the embodiment of the present invention shown in FIG. 3A and FIG. 3B.

FIG. 3A illustrates another embodiment of the present invention. The front lower flap 6 has a flap lower half 60 abutting a flap upper half 65 along a fold line 69. A cut 68 through front lower flap 6 outlines a fold line locking tab 62. When the flap upper half 65 is folded inward and downward onto the inner surface of the flap lower half 60, edge locking tabs 66 are inserted into slots 67 located on seam 81 to assist holding it in the folded position, as illustrated in FIGS. 3B and 3C.

Figure 3D:
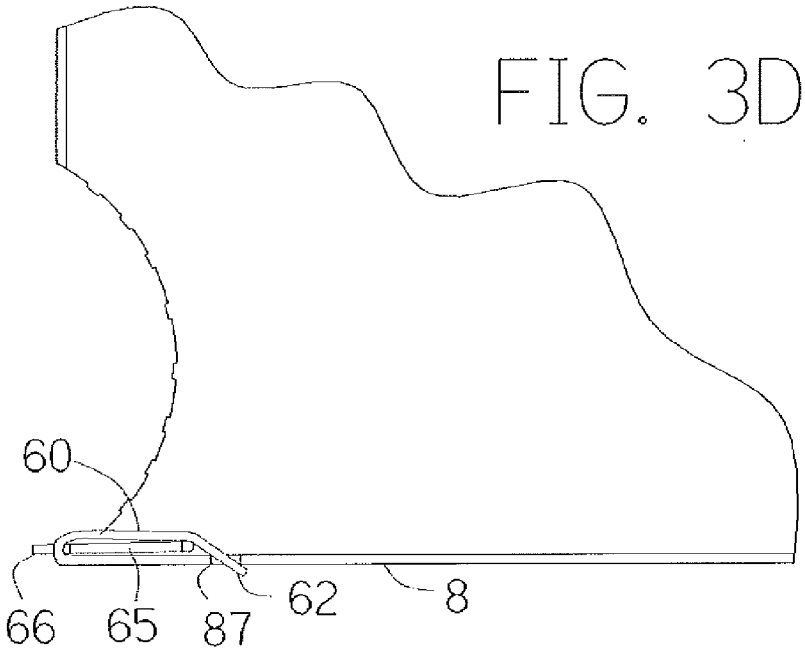
FIG. 3D is a fragmentary sectional side elevational view of the embodiment of the present invention shown in FIGS. 3A-3C with the dispenser flap folded upon itself and then folded down to the bottom surface of the carton and secured by locking tabs.

FIG. 3D illustrates the flap lower half 60 after it is folded inward and downward onto the lower panel 8. The fold line locking tab 62 is inserted through a lower panel slot 87 in the lower panel 8 to assist holding the folded flap in position abutting lower panel 8.

Figure 4A:
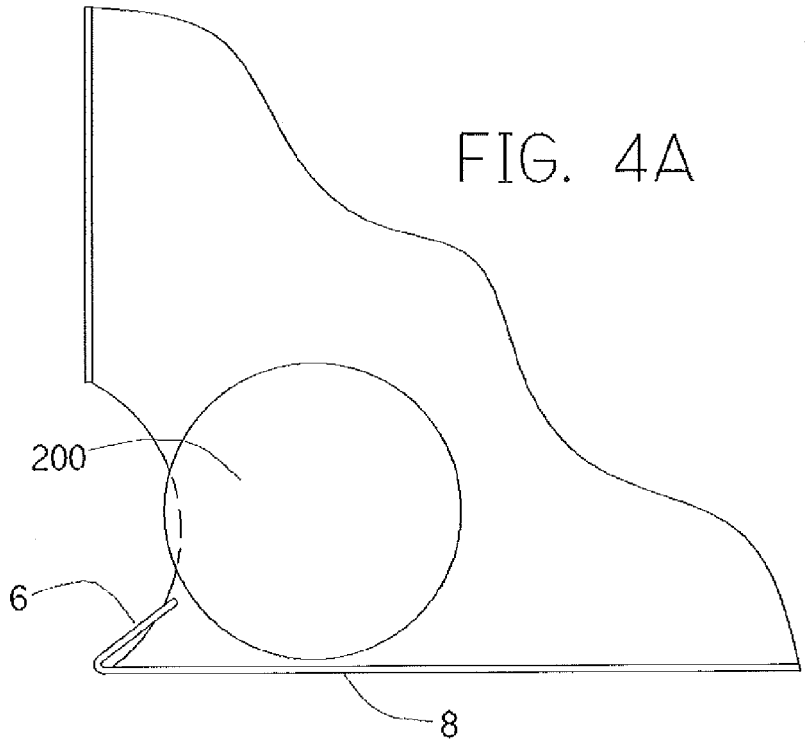
FIG. 4A is a fragmentary sectional side elevational view of another embodiment of the present invention with a short dispenser flap that is not folded upon itself but is tucked under a can.

FIG. 4A illustrates another embodiment of the present invention. The height of the front lower flap 6 is less than the radius of the beverage can 200. The front lower flap 6 is folded inward toward the lower panel 8 and tucked under the can 200 without being folded in half. In other embodiments of the present invention, the front lower flap 6 can be folded upon itself more than once, or it can be rolled up upon itself into a substantially cylindrical shape.

Figure 4B:
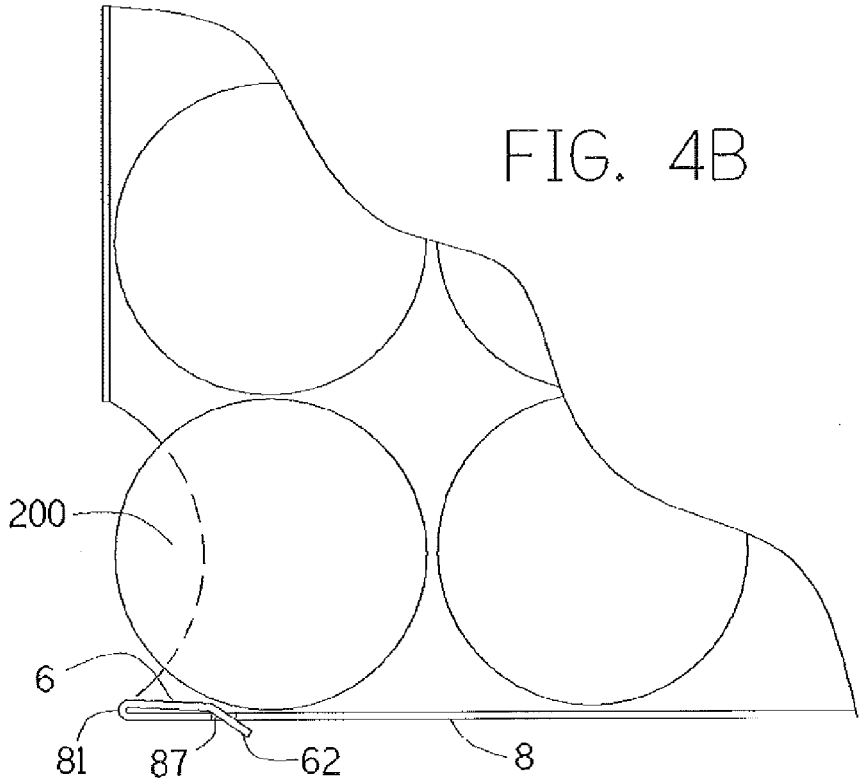
FIG. 4B is a fragmentary sectional side elevational view of the embodiment of the present invention shown in FIG. 4A with a short dispenser flap folded down to the bottom surface of the carton and secured by locking tabs.

FIG. 4B illustrates the embodiment of FIG. 4A with the fold line locking tab 62 to hold the front lower flap 6 in position against the lower panel 8. The front lower flap 6 is folded inward and downward and tucked under the can 200 without being folded in half. The height of the front lower flap 6 from the seam 81 to the edge locking tab 62 is less than the radius of the beverage can 200.

Figure 5A:
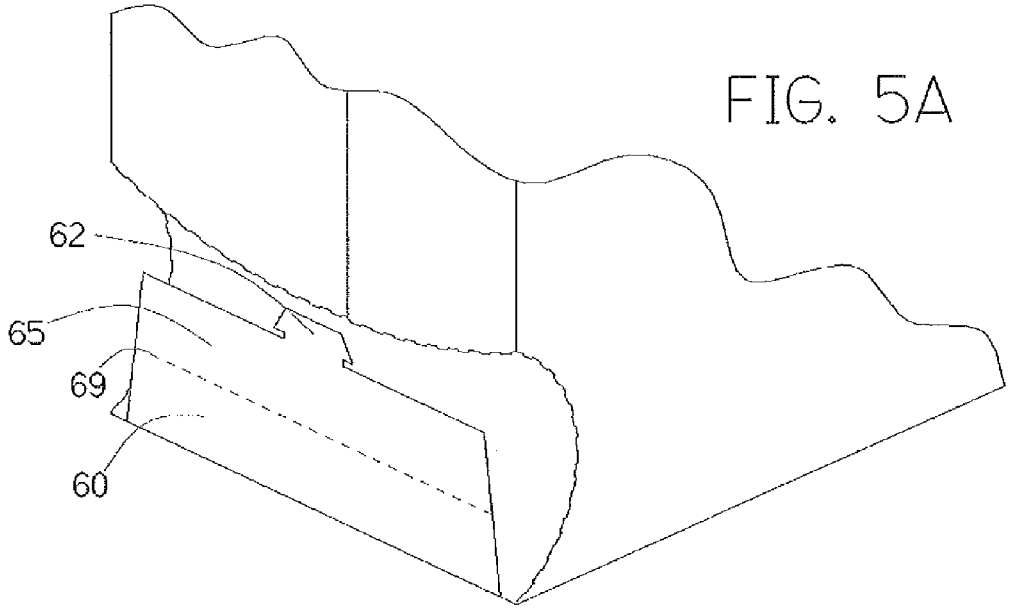
FIG. 5A is a fragmentary perspective view of another embodiment of the present invention with a locking tab with the dispenser partially opened.

FIG. 5A illustrates another embodiment of the present invention with the tear outs removed. A flap upper half 65 has an edge locking tab 62 and adjoins a flap lower half 60 along a fold line 69.

Figure 5B:
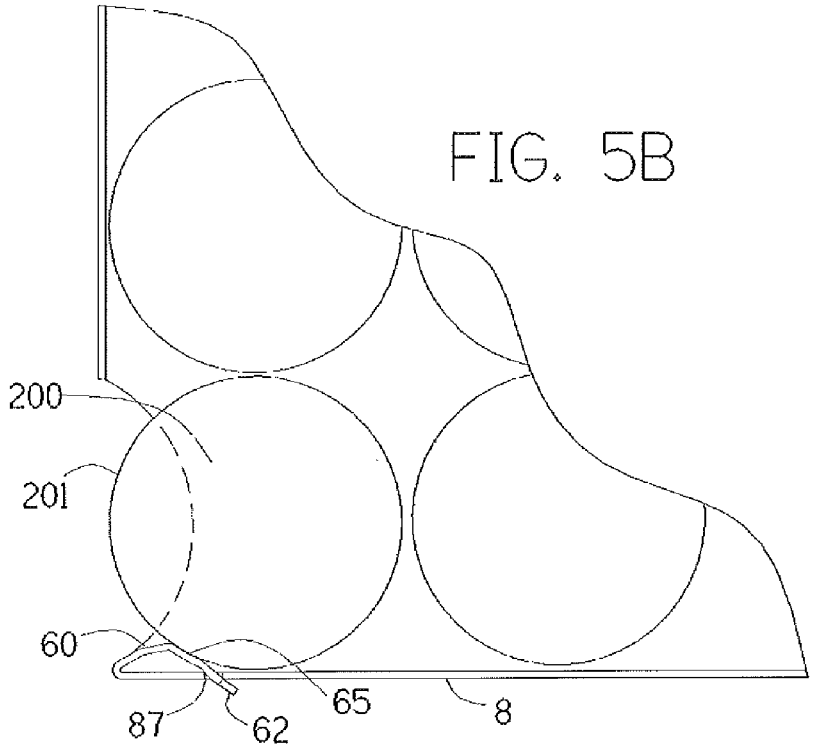
FIG. 5B is a fragmentary sectional side elevational view of the embodiment of the present invention shown in FIG. 5A with a dispenser flap that is partially folded, tucked under a can, and secured by locking tab to the bottom surface of a carton.

FIG. 5B illustrates the embodiment of FIG. 5A with the edge locking tab 62 inserted through the lower panel 8 at a lower panel slot 87. The flap upper half 65 in combination with the flap lower half 60 produce a tent-like profile similar to a wheel chock to prevent the can 200 from inadvertent ejection from the carton 100. The dimensions of the flap upper half 65, the flap lower half 60, and the location of the slot 87 are chosen so that the can 200 is held completely within the carton 100. Therefore, the carton 100 and the dispenser take up no more room in a refrigerator than an unopened carton. In addition, the cans are balanced in vertical alignment, and therefore, further prevent inadvertent ejection. In practice, the flap upper half 65 can be biased into a concave surface by the pressure of the cylindrical surface 201 of the can 200. Also in practice, the flap lower half 60 can be biased into a convex surface by the pressure of the can 200. The upper and lower sections of flap 6 have been described as flap upper half and flap lower half for ease of visualization but they do not have to be equal in their dimensions.

The diagrams illustrate various embodiments of the present invention. There is a long recognized need to prevent cans from inadvertently falling through the dispensing opening of common beverage cartons. The prior art shows a number of attempts to solve this problem and overcome the long recognized need. The present invention discloses a new and effective solution to this well known problem. The present invention accomplishes this without requiring an increase in cost of the carton or of the packaging process. Furthermore, the present invention does not require changes in the design or procedures of the many separate expensive industrial machines that create the carton blanks, assemble the cartons, fill the cartons and transport the filled cartons.

This invention is clearly new and useful. Moreover, it was not obvious to those of ordinary skill in this art at the time it was made.

It will thus be seen that the objects set forth above, and those made apparent from the foregoing description, are efficiently attended. Since certain changes may be made in the foregoing construction without departing from the scope of the invention, it is intended that all matters contained in the foregoing construction or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall there between.

What is claimed is:

1. A one-piece carton dimensioned to package conventional size twelve-ounce beverage cans in three-can-high configurations such as twelve-packs and eighteen-packs comprising:

a hollow carton comprised of a plurality of panels and including a front end closure structure, the hollow carton adapted to receive and store a plurality of cans therein;

a tear out section formed by a linear array of serrations on at least a portion of the front end closure structure, the serrations forming a tear out section border at every location where the tear out section adjoins a carton panel, wherein tearing the linear array of serrations completely separates the tear out section from the carton and forms a dispenser opening, and wherein portions of the dispenser opening are shorter than the diameter of a can at the dispenser opening;

a front lower flap hingedly attached to a lower panel of the hollow carton, the front lower flap having an upper edge spaced from a line formed by the hinged attachment of the front lower flap to the lower panel, wherein the distance between the upper edge and the line formed by the hinged attachment is less than the diameter of the can; and a solely-one fold line on solely the front lower flap, the fold line located at a length from the line formed by hinged attachment that provides folding the upper edge in upon the front lower flap, provides the upper edge contacting the front lower flap to form a folded flap, and further provides folding the folded flap into the hollow carton along the line formed by the hinged attachment of the front lower flap to the lower panel to a point under the cans at the dispenser opening, wherein the folded flap is in contact with the lower panel and supported by the lower panel to form a can stop barrier to militate against inadvertent ejection of the can at the dispenser opening from the hollow carton and wherein the can stop barrier consists solely of the front lower flap and is located entirely within the carton to secure the position of the can at the dispenser opening substantially within the carton.

2. The carton of claim 1, wherein the fold line is formed by one of a linear array of serrations and a linear indentation.

3. The carton of claim 2, wherein the fold line is located substantially at a midpoint between the line formed by the hinged attachment of the front lower flap to the lower panel and the upper edge of the front lower flap.

4. The carton of claim 1, wherein the fold line is located at a distance between the fold line and the line formed by the hinged attachment of the front edge to the lower panel that is less than a radius of the can at the dispenser opening, whereby the upper edge is foldable in upon the front lower flap along the fold line to form a folded flap, and wherein the folded flap is foldable into the carton to a point under the can at the dispenser opening to contact an outer surface of the can at the dispenser opening to form a barrier that prevents inadvertent ejection of the can at the dispenser opening from the carton.

5. The carton of claim 1, wherein the front lower flap further comprises:

an edge locking tab extending laterally outwardly from the upper edge, and a slot located on the line formed by the hinged attachment of the front edge to the lower panel to receive the edge locking tab to secure the upper edge when the front lower flap is folded along the fold line to form the folded flap.

6. The carton of claim 1, wherein the front lower flap further comprises:

a fold line locking tab formed by at least one cut through the front lower flap, whereby the locking tab extends upwardly from the fold line when the front lower flap is folded along the fold line to form the folded flap, and a slot formed in the lower panel to receive the fold line locking tab and secure the folded flap when folded under the can.

7. The carton of claim 1, the front enclosure structure further comprising:

a front right flap;

an edge on the front right flap;

a slit located on the front right flap starting at the edge of the front right flap whereby the removal of the tear out section is facilitated by the slit located on the front right flap;

a front left flap;

an edge on the front left flap; and a slit located on the front left flap starting at the edge of the front left flap whereby the removal of the tear out section is facilitated by the slit located on the front left flap.

8. The carton of claim 1, further comprising:

a right side panel hingedly attached to the front end closure structure;

a left side panel hingedly attached to the front end closure structure;

and the tear out section further comprising, a right side tear out section formed on at least a portion of the right side panel;

a finger tab formed by a cut-through extending rearwardly from the right side tear out section, whereby the finger tab can be pressed inwardly to facilitate grasping and removing the right side tear out section, a left side tear out section formed on at least a portion of the left side panel; and a finger tab formed by a cut-through extending rearwardly from the left side tear out section, whereby the finger tab can be pressed inwardly to facilitate grasping and removing the left side tear out section.

9. The carton of claim 1, the front enclosure structure further comprising:

a right front flap;

a left front flap;

a thumb tab extending downwardly from a lower corner of the front right flap to facilitate removal of the tear out section on the front right flap; and a thumb tab extending downwardly from a lower corner of the front left flap to facilitate removal of the tear out section on the front left flap.

10. The carton of claim 1, wherein the distance between the fold line and the line formed by the hinged attachment of the front lower flap to the lower panel is substantially equal to a radius of the can at the dispenser opening minus the square root of a diameter of the can at the dispenser opening times an effective height of the folded flap minus the square of the effective height of the folded flap and wherein the effective height is substantially greater than twice the thickness of the front lower flap.

11. The carton of claim 1, further comprising indicia on the front lower flap including instructions for folding the flap.

12. A one-piece carton for the packaging, transportation and storage of multiple storage cans of a beverage or the like with a dispenser opening for a storage can comprising:

a lower panel;

a right side panel hingedly attached to the lower panel;

a left side panel hingedly attached to the lower panel;

an upper right flap hingedly attached to the right side panel;

an upper left flap hingedly attached to the left side panel and affixed to the upper right flap whereby an upper structure is formed;

a rear upper right flap hingedly attached to the upper right flap;

a rear upper left flap hingedly attached to the upper left flap;

a rear right flap hingedly attached to the right side panel;

a rear left flap hingedly attached to the left side panel;

a rear lower flap hingedly attached to the lower panel, wherein at least one of the rear upper right flap, the rear upper left flap, the rear right flap, the rear left flap, and the rear lower flap is affixed to at least one of the rear upper right flap, the rear upper left flap, the rear right flap, the rear left flap, and the rear lower flap, whereby a rear end closure structure is formed;

a front upper right flap hingedly attached to the upper right flap;

a front upper left flap hingedly attached to the upper left flap;

a front right flap hingedly attached to the right side panel;

a front left flap hingedly attached to the left side panel;

a front lower flap hingedly attached to the lower panel, the front lower flap having an upper edge substantially parallel to a line formed by the hinged attachment of the front lower flap to the lower panel, wherein the front lower flap is not fixedly attached to the front right flap or the front left flap, and wherein at least one of the front upper right flap, the front upper left flap, the front right flap and the front left flap is affixed to at least one of the front upper right flap, the front upper left flap, the front right flap and the front left flap, whereby a front end closure structure is formed;

an array of serrations formed on the left side panel, the right side panel, the front right flap, and the front left flap, wherein the array of serrations forms a tear out section on the front end closure structure, whereby the tear out section is completely separated from the carton to form a dispenser opening in the carton that provides access for a user to grasp a single storage can disposed in the carton at the a dispenser opening and remove the storage can from the carton, wherein the front lower flap remains attached to the lower panel when the tear out section is removed to form the dispenser opening and wherein the height of the dispenser opening is less than the diameter of the storage can; and a fold line formed solely in the front lower flap, wherein the fold line is located substantially at a midpoint between the line formed by the hinged attachment of the front lower flap to the lower panel and the upper edge of the front lower flap and wherein the distance between the fold line and the line formed by the hinged attachment of the front lower flap to the lower panel is less than a radius of the storage can, whereby the upper edge is foldable in upon the front lower flap along the fold line to contact the lower flap to form a folded flap, and wherein the folded flap is foldable into the carton to contact the lower panel a point at least partially under the storage can at the dispenser opening and to contact an outer surface of the storage can to form a can stop barrier that prevents inadvertent ejection of the storage can from the carton wherein the can stop barrier consists solely of the front lower flap and is located entirely within the carton to secure the position of the can at the dispenser opening substantially within the carton.

13. The carton of claim 12, further comprising:

an edge locking tab extending from the upper edge; and a slot located on the lower panel that receives the edge locking tab wherein the upper edge is secured to the lower panel when the front lower flap is partially folded upon itself and tucked under a storage can at the dispenser opening to form a partially folded flap wherein the partially folded flap forms a tent-like profile and a height of the tent-like profile is less than a radius of the storage can whereby the partially folded flap contacts a circumference of the storage can to form a barrier that prevents inadvertent ejection of the storage can from the carton.

14. A method of preventing inadvertent ejection of a storage can from a dispenser opening on a front lower end of a carton wherein the dispenser opening is formed from a plurality of tear out sections, in combination with a front lower flap, an upper edge on the front lower flap and a fold line on the front lower flap, the method comprising the steps of:

removing the tear out sections completely from the carton;

preserving the attachment of the front lower flap to the carton;

folding the upper edge downward and inward upon the front lower flap along the fold line to form a folded flap; and folding the folded flap into the carton to contact a lower panel under a storage can at the dispenser opening and to contact an outer surface of the storage can to form a can stop barrier that prevents inadvertent ejection of the storage can from the carton, wherein the can stop barrier consists solely of the front lower flap and is located entirely within the carton to secure the position of the storage can at the dispenser opening substantially within the carton.

15. The method of claim 14, further comprising the step of inserting an edge locking tab into a slot in a line formed by the hinged attachment of the front lower flap to a lower panel.

16. The method of claim 14, further comprising the step of inserting a fold line locking tab into a slot in a lower panel.

17. The method of claim 14, further comprising the step of folding the front lower flap inwardly and downwardly upon itself a plurality of times.

18. The method of claim 14 further comprising the steps of:

forming a partially folded flap with a tent-like profile by folding the upper edge downwardly and inwardly toward the front lower flap along the fold line without the upper edge contacting the front lower flap, folding the partially folded flap into the carton wherein the partially folded flap is located within the carton; and inserting a locking tab into a slot in a lower panel to form a structure like a wheel chock to contact an outer surface of the storage can at the dispenser opening.

* * * * *